US011572598B2

(12) United States Patent
Nishida

(10) Patent No.: US 11,572,598 B2
(45) Date of Patent: Feb. 7, 2023

(54) MARTENSITE-BASED STAINLESS STEEL COMPONENT AND METHOD FOR MANUFACTURING THE SAME

(71) Applicant: HITACHI METALS, LTD., Tokyo (JP)

(72) Inventor: Junichi Nishida, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 442 days.

(21) Appl. No.: 16/701,177

(22) Filed: Dec. 3, 2019

(65) Prior Publication Data

US 2020/0172990 A1 Jun. 4, 2020

(30) Foreign Application Priority Data

Dec. 4, 2018 (JP) ..... JP2018-227497

(51) Int. Cl.

| | |
|---|---|
| ***C21D 6/00*** | (2006.01) |
| ***C22C 38/04*** | (2006.01) |
| ***C22C 38/44*** | (2006.01) |
| ***C21D 1/18*** | (2006.01) |
| ***C22C 38/48*** | (2006.01) |
| ***C22C 38/46*** | (2006.01) |
| ***C22C 38/00*** | (2006.01) |
| ***C22C 38/02*** | (2006.01) |

(52) U.S. Cl.

CPC ..... *C21D 6/008* (2013.01); *C21D 1/18* (2013.01); *C21D 6/004* (2013.01); *C21D 6/005* (2013.01); *C22C 38/001* (2013.01); *C22C 38/02* (2013.01); *C22C 38/04* (2013.01); *C22C 38/44* (2013.01); *C22C 38/46* (2013.01); *C22C 38/48* (2013.01); *C21D 2211/008* (2013.01); *C21D 2241/00* (2013.01)

(58) Field of Classification Search

CPC ..... C22C 38/04; C22C 38/22; C21D 6/002; C21D 6/005; C21D 2211/008

See application file for complete search history.

(56) References Cited

U.S. PATENT DOCUMENTS

2007/0023107 A1* 2/2007 Westin ..... C22C 38/02 420/66

FOREIGN PATENT DOCUMENTS

| | | |
|---|---|---|
| CN | 1458983 | 11/2003 |
| CN | 104471095 | 3/2015 |
| DE | 4033706 | 2/1991 |
| JP | 2010138425 | 6/2010 |
| JP | 5370813 B2 * | 12/2013 |
| WO | 2017150738 | 9/2017 |

OTHER PUBLICATIONS

English translation of JP5370813B2 from EPO, dated Apr. 23, 2022 (4 pages) (Year: 2022).*

Office Action of China Counterpart Application, with English translation thereof, dated Feb. 8, 2022, pp. 1-12.

Parrish, G. et al.,"effect of microstructure on the performance of surface carburized parts", China Railvvay Press, vol. 38, Feb. 1985, with Partial English translation, pp. 1-3.

Falls et al.,"Electrochemical Thermal Treatment of Metals and Alloys", Mechanical Industry Press, Oct. 1987, with Partial English translation, pp. 1-3.

Left Rude River et al., "Figure saying shiny metallic star-stainless steels", Giring Publishing Group LLC, Apr. 2012, with Partial English translation, pp. 1-3.

* cited by examiner

*Primary Examiner* — Adam Krupicka

(74) *Attorney, Agent, or Firm* — JCIPRNET

(57) ABSTRACT

Provided is a martensite-based stainless steel component that has a nitride layer on a surface of a martensite-based stainless steel with a constituent composition including, in percent by mass, 0.25 to 0.45% of C, 1.0% or less of Si, 0.1 to 1.5% of Mn, 12.0 to 15.0% of Cr, and 0.5 to 3.0% of Mo, with a remainder being Fe and impurities, wherein hardness at a position of a depth of 0.1 mm from a surface of the martensite-based stainless steel component is 650 HV or more, and a number density of carbide with an equivalent circle diameter of 1 μm or more is 100 particles/10000 $\mu m^2$ in a sectional structure at the position of the depth of 0.1 mm from the surface of the martensite-based stainless steel component. Also, a method for manufacturing the martensite-based stainless steel component is provided.

11 Claims, 3 Drawing Sheets

MARTENSITE-BASED STAINLESS STEEL COMPONENT AND METHOD FOR MANUFACTURING THE SAME

CROSS-REFERENCE TO RELATED APPLICATION

This application claims the priority benefit of Japan Application No. 2018-227497, filed on Dec. 4, 2018. The entirety of the above-mentioned patent application is hereby incorporated by reference herein and made a part of this specification.

BACKGROUND

Technical Field

The disclosure relates to a martensite-based stainless steel component that can be used as various sliding components and high-strength components, for example, that are used in corrosive environments and a method for manufacturing the same.

Description of Related Art

Conventionally, the fact that properties such as corrosion resistance and hardness of stainless steel components are improved by adding nitrogen to a stainless steel is known. Also, as a method of adding nitrogen, performing "nitrogen absorption processing" for heating and holding the stainless steel at a high temperature of about 1000° C. in a nitrogen atmosphere is known.

For example, Patent Document 1 (Japanese Laid-open No. 2010-138425) proposes a martensite-based stainless steel obtained by heating a steel material comprising, in percent by mass, C in a range of 0.26 to 0.40%, Si in a range of 1% or less, Mn in a range of 1% or less, P in a range of 0.04% or less, S in a range of 0.03% or less, Cr in a range of 12 to 14%, N in a range of 0.02% or less, and B in a range of 0.0005 to 0.002%, with the remainder being Fe and inevitable impurities, in a nitrogen atmosphere, making a concentration of nitrogen in a surface layer to 0.25 to 0.3%, and then performing water quenching thereon". Also, Patent Document 1 proposes that the aforementioned heating in a nitrogen atmosphere is performed by "a solid-phase nitrogen absorption method of holding the material for 1 to 3 hours in a nitrogen atmosphere of 1200° C. at 0.1 MPa" as the nitrogen absorption processing for obtaining the martensite-based stainless steel.

Also, Patent Document 2 (International Publication No. 2017/150738) proposes "a stainless steel component that has a constituent composition of, in percent by mass, 0.10 to 0.40% of C, 1.00% or less of Si, 0.10 to 1.50% of Mn, 10.0 to 18.0% of Cr, and 2.00% or less of N, with the remainder being Fe and impurities, has a martensite structure with an average crystal particle diameter of 20 μm or less, and has a thickness of 0.3 mm or less, in which an amount of N in a range from a surface of the stainless steel component at least to a depth of 0.05 mm is 0.80 to 2.00% by mass, and the hardness in the range is 650 HV or more". Also, Patent Document 2 proposes "heating and holding stainless steel with a thickness of 0.3 mm or less at 860° C. or more in a nitrogen atmosphere and then cooling the stainless steel" for nitrogen absorption processing for obtaining the stainless steel component, and also proposes further "performing quenching and tempering" on the stainless steel member manufactured by the nitrogen absorption processing.

Patent Documents 1 and 2 disclose methods that are effective for raising the surface hardness of martensite-based stainless steel components. However, in the case of Patent Document 1, the temperature of the aforementioned nitrogen absorption processing (solid-phase nitrogen absorption method) may become higher than an ordinary quenching temperature when the processing is performed using quenching heating and this may affect mechanical properties of the component. Also, in the case of Patent Document 2, a case in which corrosion resistance of the component after the quenching and the tempering becomes insufficient is conceivable.

SUMMARY

An embodiment of the disclosure provides a martensite-based stainless steel component that has a nitride layer on a surface of martensite-based stainless steel with a constituent composition of, in percent by mass, 0.25 to 0.45% of C, 1.0% or less of Si, 0.1 to 1.5% of Mn, 12.0 to 15.0% of Cr, and 0.5 to 3.0% of Mo, with the remainder being Fe and impurities, in which a hardness at a position of a depth of 0.1 mm from a surface of the martensite-based stainless steel component is 650 HV or more, and a number density of carbide particles with an equivalent circle diameter of 1 μm or more is 100 particles/10,000 $\mu m^2$ or less in a sectional structure at the position of a depth of 0.1 mm from the surface of the martensite-based stainless steel component.

In addition, an embodiment of the disclosure provides a method for manufacturing a martensite-based stainless steel component including: performing quenching of heating martensite-based stainless steel with a constituent composition of, in percent by mass, 0.25 to 0.45% of C, 1.0% or less of Si, 0.1 to 1.5% of Mn, 12.0 to 15.0% of Cr, and 0.5 to 3.0% of Mo, with the remainder being Fe and impurities, at a temperature of 1000 to 1150° C. in a nitrogen atmosphere and then cooling the martensite-based stainless steel, and then performing tempering thereon.

DESCRIPTION OF THE EMBODIMENTS

Figure 1:
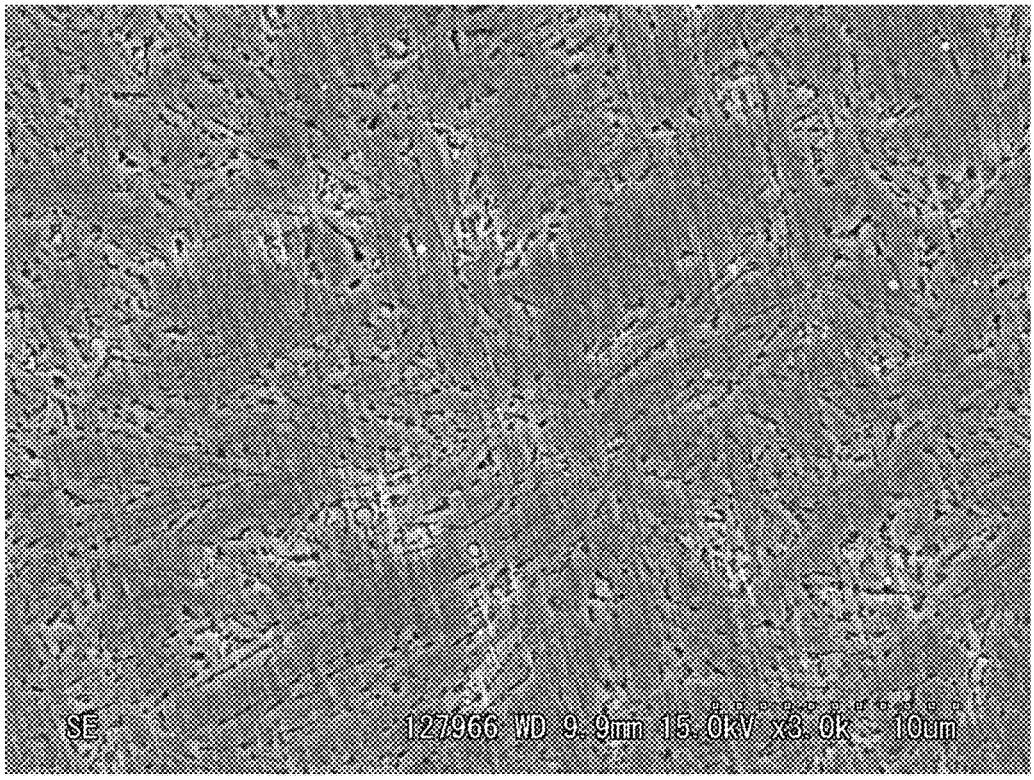
FIG. 1 is a scanning electron microscope photograph illustrating a sectional structure of a surface layer portion of a component 8 evaluated in an example.

One or some exemplary embodiments of the disclosure are characterized in that it has been able to propose that there is a combination of a constituent composition and a surface layer form of a martensite-based stainless steel component suitable for achieving both excellent corrosion resistance and fatigue strength of the martensite-based stainless steel component. Since a processing temperature of nitrogen absorption processing can be lowered as long as a martensite-based stainless steel component with a combination of this constituent composition and this surface layer form is employed, it is possible to set a quenching temperature to an "ordinary (standard) low" temperature when an effect of the nitrogen absorption processing is obtained during quenching heating, for example. Also, such a martensite-based stainless steel component can be used for various sliding components, high-strength components, and the like such as a blade, a plastic molding tool, or a punch, for example.

One or some exemplary embodiments of the disclosure provide a martensite-based stainless steel component with sufficiently high surface hardness and excellent corrosion resistance and fatigue strength and a method for manufacturing the same.

The inventor has studied a method that enables absorption of nitrogen by a required amount without raising a processing temperature of nitrogen absorption processing. As a result, the inventor discovered that an improvement in the constituent composition of a martensite-based stainless steel is effective. Also, the inventor has ascertained that it is possible to provide excellent corrosion resistance and fatigue strength to the component by setting a hardness of the surface layer of the component to be 650 HV or more without causing an excess amount of N to be absorbed into the center of the component merely by adjusting a structure of a "nitride layer" in a surface layer portion of the component when the component is finished after quenching and tempering. In addition, employing the aforementioned improved constituent composition of the martensite-based stainless steel is effective for achieving the form of such a nitride layer in the surface layer portion such that it is possible to lower a processing temperature (that is, a quenching temperature) of nitrogen absorption processing, and the inventor has thus realized the embodiments of the disclosure.

Also, in the martensite-based stainless steel component, a thickness of a compound layer that the nitride layer may be 1 μm or less.

In one or some exemplary embodiments of the disclosure, the constituent component of the martensite-based stainless steel may further include one or more kinds of 0.3% or less of Nb, 0.3% or less of V, 3.0% or less of W, and 1.0% or less of Ni, in percent by mass.

According to one or some exemplary embodiments of the disclosure, it is possible to provide excellent corrosion resistance and fatigue strength to the martensite-based stainless steel component.

Hereinafter, the martensite-based stainless steel component according to the embodiments of the disclosure will be described along with a manufacturing method for achieving it.

(1) The martensite-based stainless steel component according to an embodiment of the disclosure has a constituent composition of martensite-based stainless steel of, in percent by mass, 0.25 to 0.45% of C, 1.0% by mass of Si, 0.1 to 1.5% of Mn, 12.0 to 15.0% of Cr, and 0.5 to 3.0 of Mo, with the remainder being Fe and impurities.

In the case of the embodiment of the disclosure, a "martensite-based stainless steel" with a constituent composition adjusted to express a martensite structure through quenching and tempering is used as this material in order to provide excellent abrasion resistance (that is, high hardness) to the component.

C: 0.25 to 0.45% by Mass (Hereinafter, Simply Referred to as "%")

C is an element that is effective for raising the hardness of the martensite structure after quenching and tempering. However, an excess amount of C may lead to crystallization of large and coarse chromium-based carbide particles in a solidified structure of an ingot during solidification in a welding step related to production of a material for the component. In addition, large and coarse chromium-based carbide particles may also remain in the material structure, remain as undissolved carbide without disappearing from the martensite structure even after quenching and tempering, serve as a starting point of corrosion, and lead to insufficient corrosion resistance of the component. Also, an excess amount of C may lead to deterioration of cold workability in a process of producing a material from the aforementioned ingot, and this may make it difficult to finish a material with predetermined dimensions. Also, if the amount of C is reduced, it is possible to provide a hardness of 650 HV or more, for example, to the surface layer portion of a component through a combination of including Mo, which will be described later, and nitrogen absorption processing (quenching heating) in the case of the embodiment of the disclosure.

Accordingly, the content of C is 0.25 to 0.45%. The content of C may be, for example, 0.28% or more, or 0.30% or more. Also, the content of C may be, for example, 0.43% or less. The content of C may also be 0.40% or less, 0.36% or less, or 0.32% or less.

Si: 1.0% or Less

Si is an element that is used as a deoxidizer or the like in a melting process and is inevitably included. In addition, an excess amount of Si may lead to deterioration of cold workability.

Accordingly, the content of Si is 1.0% or less. The content of Si may be, for example, 0.8% or less. The content of Si may also be 0.65% or less. The content of Si may also be 0.5% or less or 0.4% or less. In addition, although a lower limit is not particularly required, a content of 0.01% or more can be practically employed. The practical lower limit may be, for example, 0.05% or more, 0.1% or more, or 0.2% or more.

Mn: 0.1 to 1.5%

Mn is an element that is used as a deoxidizer or the like in a melting process and is inevitably included. In addition, in particular, Mn is an element that has an effect of promoting dissolution of nitrogen with a structure in the nitrogen absorption processing, which will be described later, in the embodiment of the disclosure. However, an excess amount of Mn may stabilize an austenite structure and make it difficult to obtain a martensite structure.

Accordingly, the content of Mn is 0.1 to 1.5%. The content of Mn may be, for example, 0.2% or more, 0.3% or more, 0.4% or more, or 0.6% or more. Also, the content of Mn may be, for example, 1.3% or less, 1.1% or less, 1.0% or less, or 0.8% or less.

Cr: 12.0 to 15.0%

Cr is an element that forms an amorphous passive film on the surface of stainless steel and provides corrosion resistance to the component. Also, Cr is an element that also has an effect of increasing the amount of nitrogen that can be dissolved in the stainless steel and works to promote dissolution of nitrogen in the nitrogen absorption processing, which will be described later, in the embodiment of the disclosure. However, an excess amount of Cr may stabilize a ferrite structure and make it difficult to obtain a martensite structure.

Accordingly, the content of Cr is 12.0 to 15.0%. The content of Cr may be, for example, less than 14.0%.

Mo: 0.5 to 3.0%

Mo is an element included for obtaining excellent corrosion resistance and fatigue strength of the martensite-based stainless steel component in the embodiment of the disclosure.

According to Patent Document 1, if B (boron) is added to martensite-based stainless steel, B is precipitated as BN in water quenching after nitrogen absorption processing along with nitrogen absorbed in a steel material surface layer in the nitrogen absorption processing during quenching heating and can raise the hardness of the steel material surface layer to 700 HV or more. However, in order to cause N to be absorbed in an amount required for the nitrogen absorption processing, it is practically necessary to raise the processing temperature to about 1200° C. in martensite-based stainless steel with such a constituent composition. In addition, a longer processing time is also needed. In addition, high-temperature nitrogen absorption processing for a long period of time is thought to bring about large and coarse crystal particles (prior-austenite particles) in the structure and deterioration of fatigue strength of the component.

Thus, the inventor studied a method that enabled absorption of a necessary amount of nitrogen without raising the processing temperature of the nitrogen absorption processing. As a result, the inventor has ascertained that an improvement in constituent composition of the martensite-based stainless steel is effective for this, and specifically, addition of "Mo" is practically effective. Although B as described above has an effect of raising hardness through precipitation of BN, the effect of raising the amount of absorbed nitrogen itself is small. Meanwhile, Mo has an effect of raising the amount of nitrogen absorbed in the nitrogen absorption processing due to its high bonding energy with nitrogen. In addition, it is possible to lower the processing temperature of the nitrogen absorption processing, and to suitably shorten the processing time, and thereby to curb an increase in size and roughness of carbide particles and crystal particles in the surface layer portion of the component therewith. Also, Mo itself has an effect of stabilizing a passive film of stainless steel in the dissolved state and also contributes to enhancement of corrosion resistance on the surface of a component. Mo acts to increase the amount of Cr at a damaged location and strengthen a recovery force of the passive film when damage is caused in the passive film due to Cr.

If conditions of the nitrogen absorption processing are adjusted on the basis of the aforementioned effects and advantages, it is possible to adjust the form of the surface layer portion (nitride layer) of the stainless steel component after the quenching and the tempering to have a carbide structure and hardness, which will be described later, and to obtain a martensite-based stainless steel component with excellent corrosion resistance and fatigue strength.

However, an excess amount of Mo may stabilize a ferrite structure and make it difficult to obtain a martensite structure similarly to Cr described above. Accordingly, the content of Mo is 0.5 to 3.0%. The content of Mo may be, for example, 0.7% or more, 1.0% or more, 1.2% or more, or 1.4% or more. Also, the content of Mo may be, for example, 2.5% or less, 2.0% or less, 1.8% or less, or 1.6% or less.

The martensite-based stainless steel according to the embodiment of the disclosure can have a constituent composition of the aforementioned types of element with the remainder being Fe and impurities as a basic constituent composition. At this time, if a large amount of N is caused to be included, it is necessary to provide a special pressurization melting facility and the like for the melting process, and this may cause crystallization of large and coarse nitride particles after solidification. Also, if the content of N is large, hardening during cold working is likely to occur when a material before quenching is finished to have a product form, the material requires to be worked by repeating intermediate annealing, and machinability is also degraded.

Accordingly, N can be included as an impurity, and for example, the content thereof should be less than 0.1%. The content of N may be, for example, 0.08% or less, 0.05% or less, or 0.03% or less. In this manner, it is easy to work a material with low hardness before quenching and tempering (for example, in an annealed state) into a product form, and it is thus possible to reduce working costs. Also, it is possible to easily add a sufficient amount of N, which is required in the embodiment of the disclosure, in the nitrogen absorption processing.

Such a basic constituent composition can also contain the following elements.

Nb: 0.3% or Less

Nb is an element that works to curb an increase in size and roughness of crystal particles when a high processing temperature is set for the nitrogen absorption processing. However, an excess amount of Nb may lead to crystallization of large and coarse Nb carbide particles and deterioration in strength of the component. Therefore, Nb is not included (not added), or if Nb is included, an upper limit thereof is set to 0.3%. The upper limit of Nb may be, for example, 0.2% or less or 0.15% or less. Also, although a small content of Nb is also effective for obtaining the aforementioned effects, the content of Nb may be, for example, 0.05% or more.

V: 0.3% or Less

V is an element that works to curb an increase in size and roughness of crystal particles in a case in which a high processing temperature of the nitrogen absorption processing is set, similarly to Nb. However, an excess amount of V may lead to precipitation and an increase in size and roughness of V-based nitride during the nitrogen absorption processing, a decrease in the amount of nitrogen dissolved in the stainless steel, and a decrease in hardness in the surface layer portion of the component after the quenching and the tempering. Accordingly, V is not included (not added), or if V is included, an upper limit thereof is set to 0.3%. The upper limit of V is may be, for example, 0.2% or less, or 0.15 or less. Also, although a small content of V is also effective for obtaining the aforementioned effects, the content of V may be, for example, 0.1% or more.

W: 3.0% or Less

W has an effect of raising the amount of nitrogen absorbed during the nitrogen absorption processing, similarly to Mo. Also, since W has less influence on the amount of dissolved nitrogen and the nitride depth, W can be included as an element that complements the main effect of Mo. However, an excess amount of W may stabilize a ferrite structure and make it difficult to obtain a martensite structure. Accordingly, W is not included (not added), or if W is included, the upper limit thereof is set to 3.0%. The upper limit of W may be, for example, 2.5% or less, 2.0% or less, or 1.5% or less. Also, although a small amount of W is also effective for obtaining the aforementioned effects, the content of W may be, for example, 0.5% or more. The content of W may also be 0.7% or more or 1.0% or more.

Ni: 1.0% or Less

Ni has an effect of curbing further advancement of corrosion in an initial stage of the corrosion even if corrosion has occurred in stainless steel. Also, Ni has an effect of enhancing toughness of a base in the structure. Further, Ni is an element that works to stabilize an austenite structure, raise a dissolution limit of N, and cause a large amount of nitrogen to be absorbed in the nitrogen absorption processing. However, an excess amount of Ni may excessively stabilize an austenite structure and make it difficult to obtain a martensite structure. Accordingly, Ni is not included (not added), or if Ni is added, the content of Ni is set to be 1.0% or less. The content of Ni may be, for example, 0.8% or less, 0.6% or less, or 0.4% or less. Also, the content of Ni for obtaining the aforementioned effects may be, for example, 0.1% or more or 0.2% or more.

(2) The martensite-based stainless steel component according to the embodiment of the disclosure has a nitride layer on the surface of the martensite-based stainless steel in (1).

The martensite-based stainless steel component according to the embodiment is made to have the nitride layer on the surface thereof by performing nitrogen absorption processing, which will be described later, (that is, quenching heating that also serves as nitrogen absorption processing), for example, on the material of the martensite-based stainless steel. In addition, the surface layer portion (nitride layer) of the component is likely to achieve the forms (3) and (4), which will be described later, and it is possible to provide excellent corrosion resistance and fatigue strength to the component, by the aforementioned material having the constituent composition in (1).

In addition, the thickness of a compound layer that the aforementioned nitride layer has may be, for example, 1 μm or less. At this time, "1 μm or less" stated above includes a case in which the aforementioned nitride layer does not have a compound layer (that is, a case in which the thickness is "0 μm"). Typically, the nitride layer is configured to include a diffused layer that is formed inward and a compound layer that is formed on the front surface side. In addition, the compound layer is a layer that is a so-called "white layer", mainly contains a ε nitride and the like, and is brittle. In the case of the embodiment of the disclosure, the compound layer may be restricted for maintaining corrosion resistance and fatigue strength of the component. Further, the nitrogen absorption processing, which will be described later, (that is, quenching heating that also serves as the nitrogen absorption processing) may be performed for curbing formation of the aforementioned compound.

(3) The hardness of the martensite-based stainless steel component according to the embodiment of the disclosure at a position of a depth of 0.1 mm from the surface is 650 HV or more.

It is not necessary to raise the overall hardness of the martensite-based stainless steel component according to the embodiment of the disclosure. Also, it is possible to provide excellent corrosion resistance and fatigue strength to the component due to the surface layer portion of the component achieving the form in (4), which will be described later, as long as the hardness at a position of a depth of 0.1 mm from the surface of the component is "650 I-IV or more" even in a case in which the hardness at a position located further inward than the aforementioned position is less than 650 HV, for example, in a case in which the hardness at the center of the component is less than 650 HV, or 630 HV or less, 600 HV or less, or 580 HV or less.

The aforementioned hardness at a position of a depth of 0.1 mm from the surface of the component may be, for example, 660 HV or more. The aforementioned hardness may also be 670 HV or more, 680 HV or more, or 690 HV or more. It is also possible to set the aforementioned hardness to 700 HV or more. Also, although it is not necessary to designate an upper limit of hardness, the upper limit is practically about 800 HV. The hardness can be measured in a sectional structure of the martensite-based stainless steel component that is perpendicular to the surface that has the nitride layer.

In addition, regarding the hardness at a position of depth 0.1 mm from the surface of the a aforementioned component being "650 HV or more", the hardness of "650 HV or more" is at a position of depth 0.2 mm from the surface of the component. The hardness of "650 HV or more" may be, for example, at a position of depth 0.3 mm from the surface of the component. In order to achieve high hardness even at such a deep position, it is effective to lengthen the holding time at the heating temperature during quenching described later. For example, the holding time is 1 hour or more, 3 hours or more, or 5 hours or more.

Thus, the martensite-based stainless steel component according to the embodiment of the disclosure can achieve excellent corrosion resistance and fatigue strength even in a case of a large component for which it is difficult to harden the inside thereof (that is, it is difficult to cause a large amount of nitrogen to be absorbed in the nitrogen absorption processing). For example, the component can have a thickness exceeding 0.1 mm or a thickness of 0.5 mm or more in a direction directed inward from the surface of the component that has the aforementioned nitride layer. Also, the component may have the aforementioned thickness of 1 mm or more, 3 mm or more, 5 mm or more, 7 mm or more, or 9 mm or more. In addition, it is not particularly necessary to set an upper limit of the thickness of the component. Also, the upper limit is practically 30 mm or 20 mm.

(4) The martensite-based stainless steel component according to the embodiment of the disclosure has a number density of carbide particles with an equivalent circle diameter of 1 μm or more in a sectional structure at a position of a depth of 0.1 mm from the surface of 100 particles/10,000 $\mu m^2$ or less.

Carbide is formed in the structure of the martensite-based stainless steel component according to the embodiment of the disclosure, in which the constituent composition of the stainless steel as a material is the aforementioned constituent composition in (1). Also, the nitride layer is formed on the surface of the martensite-based stainless steel component according to the embodiment of the disclosure through the nitrogen absorption processing. Also, due to the nitride layer being formed, nitrogen absorbed through the nitrogen absorption processing dissolves in a matrix and bonds with nitride formation elements such as Cr and Mo in the stainless steel, thereby forming carbonitrides in the surface layer portion of the martensite-based stainless steel component according to the embodiment of the disclosure.

In such a martensite-based stainless steel component, including more carbides and carbonitrides (hereinafter, collectively handled as "carbides" in the embodiment of the disclosure) in the surface layer portion is more effective in terms of an improvement in abrasion resistance of the component (hardness of the surface layer portion). However, if the carbides are large and coarse, fatigue starting from the carbides is likely to occur, and fatigue strength of the component deteriorates. Also, the carbides may become a starting point of corrosion, and this may lead to deterioration of corrosion resistance. Thus, the amount of large and coarse carbide particles in the surface layer portion is reduced in the case of the embodiment of the disclosure in order to improve corrosion resistance and fatigue strength of the component.

Also, the inventor has ascertained, as a result of studies, that defining of the aforementioned large and coarse carbide as "the carbide with an equivalent circle diameter of 1 μm or more", defining the aforementioned position in the surface layer portion as "the sectional structure at the position of a depth of 0.1 mm from the surface of the component", and reducing the number density of the aforementioned carbide at this position to 100 particles/10000 $\mu m^2$ or less are effective for improving corrosion resistance and fatigue strength of the component. "100 particles/10000 $\mu m^2$ or less" described above also includes a case in which a carbide with an equivalent circle diameter of 1 μm or more is not observed (that is, in a case of "0 particles/10000 $\mu m^2$"). In addition, the number density may be, for example, 80 particles/10000 $\mu m^2$ or less, 50 particles/10000 $\mu m^2$ or less, 30 particles/1000 $\mu m^2$ or less, or 10 particles/10000 $\mu m^2$ or less. In this manner, start points of corrosion or fatigue in the surface layer portion of the component are reduced, and corrosion resistance and fatigue strength of the component are improved. Also, as a result, the carbide at the surface layer portion of the component is refined, the nitrogen absorbed during the nitrogen absorption processing is also dissolved in the base, and sufficient hardness of the surface layer portion of the component is maintained.

Also, in the above description, the "sectional structure" in which a carbide distribution state is measured can be a sectional structure that is perpendicular to the surface of the martensite-based stainless steel component that has the nitride layer. In addition, it is possible to count the number of carbide particles with a circular corresponding diameter (which is an area equivalent circle diameter) of 1 μm or more by observing the sectional structure with a scanning electron microscope and performing image analysis on a field-of-view area corresponding to 10000 $\mu m^2$. In addition, identification of the carbon can be checked through element mapping performed with an electron probe micro-analyzer (EPMA) provide in the scanning electron microscope.

(5) According to a method for manufacturing a martensite-based stainless steel component according to an embodiment of the disclosure, quenching of heating the aforementioned martensite-based stainless steel in (1) at a temperature of 1000 to 1150° C. in a nitrogen atmosphere and cooling the martensite-based stainless steel is performed, and tempering is then performed thereon.

The quenching and the tempering are performed for adjusting mechanical properties of the martensite-based stainless steel to a state suitable for an application. As for the quenching among these, quenching that accompanies nitrogen absorption processing is performed on the aforementioned martensite-based stainless steel in (1) in the embodiment of the disclosure. Also, it is possible to set the quenching temperature to a temperature that is as low as "1000 to 1150° C." which is applied to a martensite-based stainless steel as standard. Then, it is possible to achieve the martensite-based stainless steel component according to the embodiment of the disclosure, in which the surface layer portion satisfies the aforementioned states (2) to (4), after the following tempering.

According to Patent Document 2, it is possible to cause nitrogen to be absorbed up to the center of the member by performing the nitrogen absorption processing on the martensite-based stainless steel and to thereby raise hardness of the surface of the component to 650 HV or more after the quenching and the tempering. However, to do so, it is necessary to set the thickness of the component to 0.3 mm or less. Since the processing temperature of the nitrogen absorption processing and the quenching temperature are different from each other, it is necessary to separately perform the nitrogen absorption processing and the quenching. Also, if a large amount of large and coarse carbide is formed in the structure of the member, for example, due to a large amount of nitrogen to be absorbed in the member and the nitrogen absorption processing that takes a long time due to the large amount of nitrogen, there is considered to be a case in which corrosion resistance and fatigue strength of the component become insufficient.

Meanwhile, the nitrogen absorption processing is performed in accordance with the quenching in the case of the embodiment of the disclosure. Also, the amount of nitrogen that can be dissolved as alloy is raised first by the martensite-based stainless steel having the aforementioned constituent composition in (1) and comprising Mo, in particular. Further, the structure of the stainless steel with the aforementioned constituent composition in (1) is sufficiently austenitized at a heating temperature of 1000° C. or more, austenite also has a structure in which the amount of nitrogen that can be dissolved is large. Accordingly, if the aforementioned martensite-based stainless steel is maintained at the heating temperature in a nitrogen atmosphere, it is possible to cause a sufficient amount of nitrogen to be dissolved without generating a compound layer in the structure of the surface layer portion in the austenite state at that time. The heating temperature may be, for example, 1050° C. or more. Also, it is possible to curb an increase in size and roughness of crystal particles and to maintain high strength of the component by setting an upper limit of the heating temperature to 1150° C. The upper limit may be, for example, 1100° C.

In addition, as for the cooling from the heating temperature, it is possible to perform quenching cooling after maintaining the temperature at the aforementioned heating temperature, for example, and absorbing a sufficient amount of nitrogen in the surface layer, by following the standard quenching conditions for a martensite-based stainless steel. At that time, the heating time maintained at the above heating temperature can be appropriately set according to the target of the surface layer, and can be set, for example, within a range of 10 minutes to 7 hours. The lower limit of the heating time is 20 minutes. The upper limit of the heating time can be set to 6 hours, 5 hours, 4 hours, 3 hours, or 2 hours. The heating time can also be set for around 1 hour. At that time, the aforementioned quenching cooling may be performed through rapid cooling in order to curb precipitation of perlite and ferrite. For example, it is possible to set a high cooling speed of 0.5° C./second or more for cooling from the heating temperature (quenching temperature) to 500° C. Moreover, the cooling speed of 1° C./second or more may be employed in order to curb precipitation of a carbide and nitride in a crystal grain boundary during the cooling and to prevent the precipitation from causing degradation of hardness and corrosion at the grain boundary.

As the aforementioned nitrogen atmosphere, it is possible to use nitrogen gas, for example. In a specific example, an atmosphere in which 90% by volume or more of nitrogen gas is contained can be use. Also, since the absorption of nitrogen from the surface of material is promoted by setting the nitrogen atmosphere to a "pressurized atmosphere" (including an atmospheric pressure), this is effective for reducing the processing time and processing costs. In this regard, causing a plasma in the nitrogen atmosphere and using more active radical nitrogen are also effective to reduce the processing time and the processing costs.

It is possible to perform the quenching according to the embodiment of the disclosure with a standard quenching pattern for a martensite-based stainless steel with the aforementioned conditions for the nitrogen absorption processing and thereby to form the surface layer portion after the quenching as a high-nitrogen martensite structure while curbing an increase in size and roughness of the carbide and the crystal particles at the surface layer portion.

In addition, sub-zero processing can be performed after the quenching as needed. It is possible to stably obtain high hardness by performing the sub-zero processing. The processing temperature can be −50° C. or less, for example. Also, the maintaining time at the processing temperature can be 30 minutes to 1 hour, for example.

Also, tempering is performed on the martensite-based stainless steel after finishing the aforementioned quenching to adjust mechanical properties such as hardness. Since the carbide precipitated in the structure through the tempering is minute, it is possible to improve abrasion resistance without degrading corrosion resistance of the component. The tempering temperature can be 150 to 650° C., for example. The maintaining time at the tempering temperature can be 30 seconds to 1 hour, for example. In this manner, it is possible to raise the hardness of the surface layer portion of the component to be as high as 650 HV or more.

At this time, it is possible to perform low-temperature tempering by setting the tempering temperature to about 200° C. or to perform high-temperature tempering by setting the tempering temperature to about 500° C. in order to raise the hardness of the surface layer portion of the component. The low-temperature tempering may be performed in a case in which emphasis is placed on corrosion resistance. Through the low-temperature tempering, it is possible to appropriately curb precipitation of a Cr-based carbide, a nitride, and the like, to secure the amount of C and the amount of N dissolved in the base, and to maintain high hardness of the surface layer portion. Also, it is possible to reduce shortage of Cr at a portion that is adjacent to the precipitation location and thereby to secure corrosion resistance as well. In addition, although the hardness is likely to decrease as the tempering temperature increases through the low-temperature tempering, a carbide of an alloy element of Mo and the like is finely precipitated at the tempering temperature of about 500° C. and is then secondary hardened. The high-temperature tempering is effective for raising softening resistance of the martensite-based stainless steel component.

EXAMPLES

Ingots of martensite-based stainless steel with a plurality of constituent compositions were produced by casting 10 kg of metal molten in a high-frequency induction melting furnace. Next, hot forging with a forging ratio (a sectional area before forging/a sectional area after forging) of about 10 was performed on these ingots, and the ingots were then cooled and annealed at 780° C., thereby obtaining annealed materials. Then, 10 mm square blocks were cut out from these annealed materials, thereby obtaining materials A to I of stainless steel (hardness of about 200 HV). Constituent compositions of the materials A to I are shown in Table 1.

TABLE 1

| | Constituent composition (mass %) | | | | | | | | | | |
|---|---|---|---|---|---|---|---|---|---|---|---|
| Material | C | Si | Mn | Ni | Cr | W | Mo | V | Nb | N | Fe* |
| A | 0.65 | 0.40 | 0.78 | 0.01 | 13.13 | 0.02 | — | 0.01 | — | 0.001 | Bal. |
| B | 0.41 | 0.24 | 0.30 | 0.06 | 16.33 | 0.20 | 2.48 | — | — | 0.160 | Bal. |
| C | 0.30 | 0.32 | 0.70 | 0.01 | 13.11 | 0.02 | 1.48 | 0.01 | — | 0.002 | Bal. |
| D | 0.31 | 0.29 | 0.64 | 0.01 | 13.02 | 0.02 | 1.49 | 0.20 | — | 0.002 | Bal. |
| E | 0.31 | 0.30 | 0.66 | 0.01 | 13.03 | 0.02 | 1.50 | 0.01 | 0.10 | 0.002 | Bal. |
| F | 0.31 | 0.31 | 0.65 | 0.01 | 12.99 | 0.98 | 1.01 | 0.01 | — | 0.002 | Bal. |
| G | 0.32 | 0.22 | 0.47 | 0.67 | 13.02 | 0.02 | 1.52 | 0.01 | — | 0.002 | Bal. |
| H | 0.40 | 0.37 | 0.81 | 0.01 | 14.63 | 0.01 | 0.98 | 0.01 | — | 0.003 | Bal. |
| I | 0.35 | 0.68 | 0.51 | 0.01 | 12.45 | 0.01 | 2.49 | 0.01 | — | 0.003 | Bal. |

Quenching heating of heating and maintaining the materials A to I in a nitrogen atmosphere comprising nitrogen gas (purity of 99%) at an atmospheric pressure or in vacuum was performed on the materials A to I, and quenching of rapidly cooling the materials to a room temperature with nitrogen gas pressurized to 2 atm was then performed thereon. Heating temperatures in the aforementioned quenching heating and maintaining times at the heating temperatures are as shown in Table 2. Sub-zero processing was performed immediately after the quenching. As conditions of the sub-zero processing, liquified carbon dioxide at −75° C. was used, and the materials were maintained therein at 60 minutes. Also, tempering of maintaining the materials at the tempering temperatures in Table 2 for 1 hours was then performed thereon, thereby obtaining components 1 to 15 of stainless steel. Also, surfaces of the components were polished by 0.02 mm to remove scales at this time.

The components 1 to 15 were divided into halves in sections that was perpendicular to the surface of the blocks that had the nitride layers. Then, Vickers hardness was measured at the surface layer portions (that is, the positions of the depths of 0.1 mm from the surfaces that had the nitride layer) and the centers (that is, the positions of 5 mm from the surfaces) in the sections. A load used for the measurement was 100 g.

Figure 2:
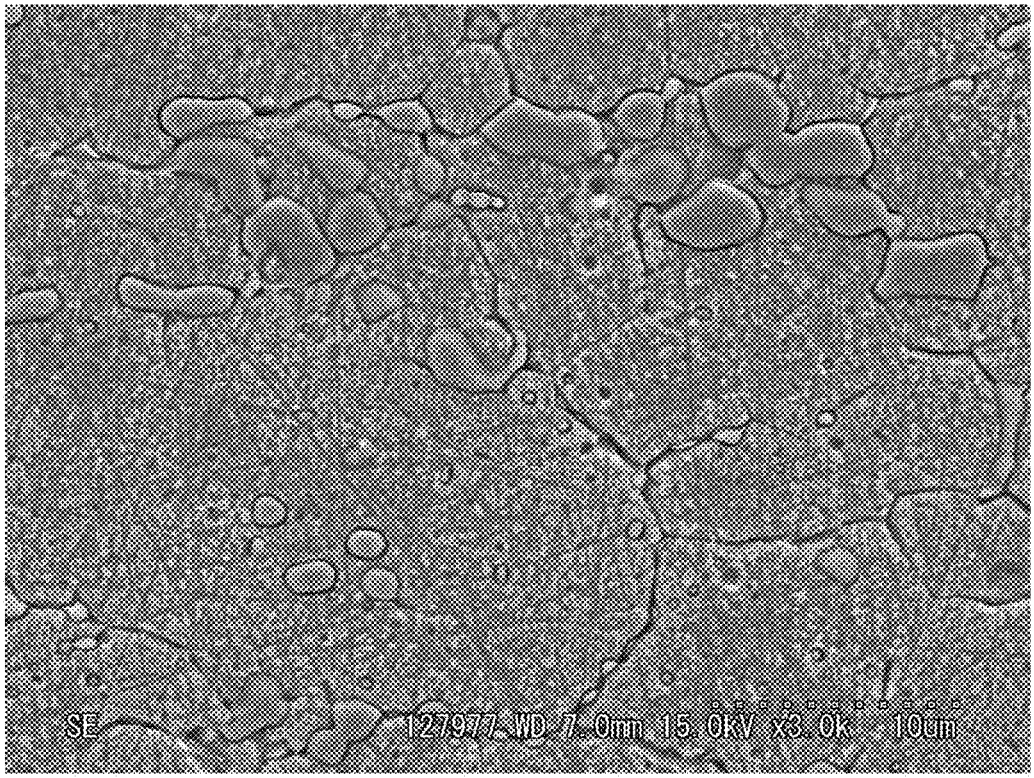
FIG. 2 is a scanning electron microscope photograph illustrating a sectional structure of a surface layer portion of a component 2 evaluated in an example.

Also, carbides at the surface layer portions of the components were also observed at the same time. An embodiment of structures at the positions of the depths of 0.1 mm from the surfaces that had the nitride layers in the aforementioned sections were observed with a scanning electron microscope (magnification of 3000 folds). FIG. 1 is a microscope image of the component 8 in Disclosure Example, and FIG. 2 is a microscope image of the component 2 in Comparative Example. In FIGS. 1 and 2, distributed substances observed in gray contrast phases (for example, the substance represented with the arrow in the drawing) in a particle form were carbides (including carbonitride). This can be confirmed through element mapping performed with an EPMA provide in the scanning electron microscope. Then, image analysis was performed on 10000 $\mu m^2$ of field-of-view area to count the number of carbide particles with an equivalent circle diameter of 1 μm or more and measure the number density (particles/10000 $\mu m^2$)

thereof. Also, image processing software "ImageJ (http://imageJ.gov/ij/)" provided by US National Institutes of Health (NIH) was used for the aforementioned image analysis. These results are also shown in Table 2.

Figure 3:
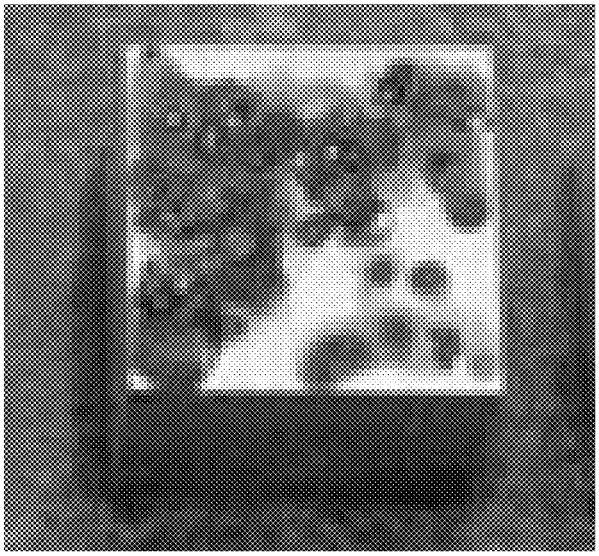
FIG. 3 is a photograph illustrating, instead of a drawing, how rust was generated after a salt-water spraying test was carried out on a component 1 evaluated in an example.
Figure 4:
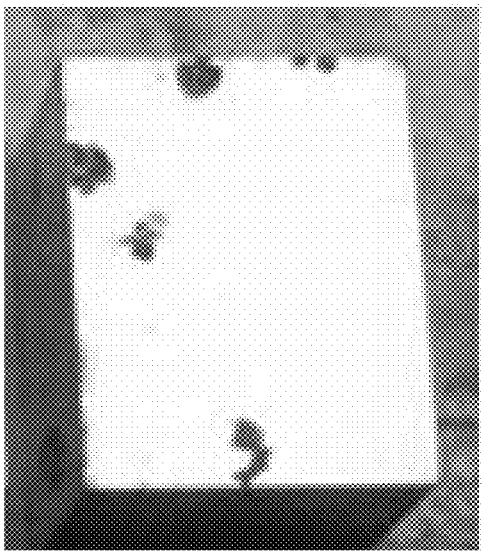
FIG. 4 is a photograph illustrating, instead of a drawing, how rust was generated after a salt-water spraying test was carried out on a component 5 evaluated in an example.

Then, a salt-water spraying test of spraying 5% salt-water at 35° C. for 5 hours was performed on the surfaces of the components 1 to 15, and corrosion resistance was evaluated. The corrosion resistance was evaluated by observing how rust was generated on the surfaces after the salt-water spraying test. As evaluation criteria, a result that less rust was generated than that in FIG. 4 (the rust generated portion was about 5% by area) was evaluated as "◎ (excellent)", a result that rust was more significantly generated than that in FIG. 4 but the rust generated portion was smaller than about 50% by area was evaluated as "○ (good)", a result that the rust generated portion was 50% by area or more but less rust was generated than that in FIG. 3 (the rust generated portion was about 70% by area) was evaluated as "Δ (ok)", and a result that the rust was more significantly generated than that in FIG. 3 was evaluated as "x (bad)" with reference to how the rust was generated as illustrated in FIGS. 3 and 4. These results are also shown in Table 2.

TABLE 2

| | | Quenching and tempering | | | component | | | | |
|---|---|---|---|---|---|---|---|---|---|
| | | Quenching heating | | | Surface layer portion | | | | |
| Component | Material | Temperature × time | Atmosphere | Tempering temperature | Number density of carbide particles) (particles/10000 $um^2$ | Hardness (HV) | Center Hardness (HV) | Salt-water spraying test | Remarks |
| 1 | A | 1050° C. × 30 min | Vacuum | 180° C. | 187 | 718 | 724 | X | Comparative Example |
| 2 | B | 1050° C. × 30 min | Vacuum | 180° C. | 395 | 705 | 703 | ◎ | Comparative Example |
| 3 | C | 1010° C. × 30 min | Nitrogen | 180° C. | 11 | 673 | 546 | ◎ | Disclosure Example |
| 4 | C | 1050° C. × 30 min | Nitrogen | 180° C. | 4 | 701 | 617 | ◎ | Disclosure Example |
| 5 | C | 1050° C. × 30 min | Nitrogen | 500° C. | 5 | 681 | 550 | ○ | Disclosure Example |
| 6 | C | 1010° C. × 30 min | Nitrogen | 180° C. | 0 | 708 | 647 | ◎ | Disclosure Example |
| 7 | D | 1050° C. × 30 min | Nitrogen | 180° C. | 23 | 726 | 596 | ◎ | Disclosure Example |
| 8 | E | 1050° C. × 30 min | Nitrogen | 180° C. | 18 | 701 | 590 | ◎ | Disclosure Example |
| 9 | E | 1100° C. × 30 min | Nitrogen | 180° C. | 12 | 726 | 646 | ◎ | Disclosure Example |
| 10 | F | 1050° C. × 30 min | Nitrogen | 180° C. | 27 | 677 | 601 | ◎ | Disclosure Example |
| 11 | G | 1050° C. × 30 min | Nitrogen | 180° C. | 8 | 698 | 625 | ◎ | Disclosure Example |
| 12 | H | 1050° C. × 30 min | Nitrogen | 180° C. | 42 | 725 | 657 | ◎ | Disclosure Example |
| 13 | I | 1050° C. × 30 min | Nitrogen | 180° C. | 39 | 708 | 627 | ◎ | Disclosure Example |
| 14 | E | 1010° C. × 180 min | Nitrogen | 180° C. | 51 | 728 | 558 | ◎ | Disclosure Example |
| 15 | E | 1010° C. × 300 min | Nitrogen | 500° C. | 42 | 717 | 545 | ○ | Disclosure Example |

The component 1 was Comparative Example produced using a typical martensite-based stainless steel comprising 0.65% of carbon as a material. In this manner, high hardness of 700 HV or more was obtained both at the surface layer portion and at the center of the component under the standard quenching conditions. However, since the amount of carbon was large, a large and coarse carbide that was not dissolved in the quenching remained at the surface layer portion, this worked as a start point of corrosion, and significant rust was generated in the salt-water spraying test.

The component 2 was Comparative Example produced using a martensite-based stainless steel to which nitrogen was added in a melting step as a material. In this manner, a large amount of nitrogen was dissolved in the base of the structure, and excellent corrosion resistance and high hardness were obtained. However, since nitrogen was added at the time of melting, a large and coarse carbide (carbonitride) was crystallized in the structure at the time of coagulation, and a large amount of large and coarse carbide was observed at the surface layer portion of the component. FIG. 2 illustrates a scanning electron microscope image of a structure section at the surface layer portion of the component 2. A large amount of carbide in a particle shape with a particle diameter (equivalent circle diameter) of 1 μm or more was observed.

The components 3 to 6 are Disclosure Examples produced by performing quenching and tempering under different conditions on martensite-based stainless steel materials with the same constituent composition. Since the materials of the components 3 to 6 contain an appropriate amount of Mo, hardness at the positions of the surface layer portions of the depths of 0.1 mm from the surfaces of the components achieved 650 HV or more within a standard condition range under any of the quenching conditions. At this time, the hardness tended to be higher as the quenching temperature increased. Also, the carbides observed in the sectional structures at the surface layer portions were also fine, a small amount of large and coarse carbide was recognized, and a carbide with an equivalent circle diameter of 1 μm or more was not recognized in the component 6. Also, no compound layer was recognized on the surface of the nitride layer. As results of the salt-water spraying test, substantially no rust was observed in the components 3, 4, and 6, and excellent corrosion resistance was achieved. In addition, the component 5 obtained by employing high tempering temperature also had sufficient corrosion resistance (the rust generated portion was about 20% by area).

The components 7 to 11 were Disclosure Examples produced by performing quenching and tempering under the same conditions on martensite-based stainless steel materials with different constituent compositions (in addition, the component 9 was obtained by changing the quenching conditions for the component 8). The components 7 to 11 were obtained by adding V, Nb, W, and Ni to the respective materials, and hardness of the surface layer portions at the positions of the depths of 0.1 mm from the surfaces achieved 650 HV or more due to appropriate amounts of Mo contained. In addition, carbides observed in the sectional structures at the surface layer portions were fine, and the amount of large and coarse carbide was small. FIG. 1 is a scanning electron microscope image of a structure section at the surface layer portion of the component 8, and the amount of carbide with a particle diameter (equivalent circle diameter) of 1 μm or more was small. The component 9 was obtained by raising the quenching temperature of the component 8. Also, an increase in size and roughness of crystal particles was curbed due to addition of Nb to the material, and the crystal particles at the surface layer portion were maintained to be fine in a similar level to the component 6. In addition, in the components 7 to 11, no compound layers were recognized on the surfaces of the nitride layers, substantially no rust was observed in the salt-water spraying test, and excellent corrosion resistance was achieved.

The component 12 was Disclosure Example produced using a martensite-based stainless steel, in which the content of C and the content of Cr were adjusted to be large, as a material. In this manner, an undissolved carbide increased, a large and coarse carbide slightly increased at the surface layer portion of the component, but high hardness of 650 HV or more was achieved at the surface layer portion. In addition, excellent corrosion resistance was achieved.

The component 13 was Disclosure Example produced using a martensite-based stainless steel, in which the content of Mo was adjusted to be large, and a material. In addition, high hardness of 650 HV or more was achieved at the surface layer portion of the component, and also, excellent corrosion resistance was achieved, similarly to the components in other Disclosure Examples.

The component 14 and 15 were Disclosure Examples in which the quenching and heating holding times were set to 180 minutes and 300 minutes, respectively, longer than the component 1 to 13. The nitriding depth tends to become deeper as the heating holding time becomes longer, and the hardness of 650 HV or more was obtained was at a position of depth 0.2 mm and 0.3 mm from the surface of the component, respectively. It was also confirmed that both component 14 and 15 had excellent corrosion resistance.

A rotary bending fatigue test was conducted on the components 1 and 2, which were Comparative Examples, and the components 4 and 8, which were Disclosure Examples. As a test piece, the quenching and the tempering in Table 2 were performed on a round bar with a parallel portion with a diameter of 6 mm collected from the annealed material obtained in Example 1, thereby obtaining a component. A surface of the component was polished by 0.02 mm to remove scales. A rotation frequency was 3000 rpm.

Figure 5:
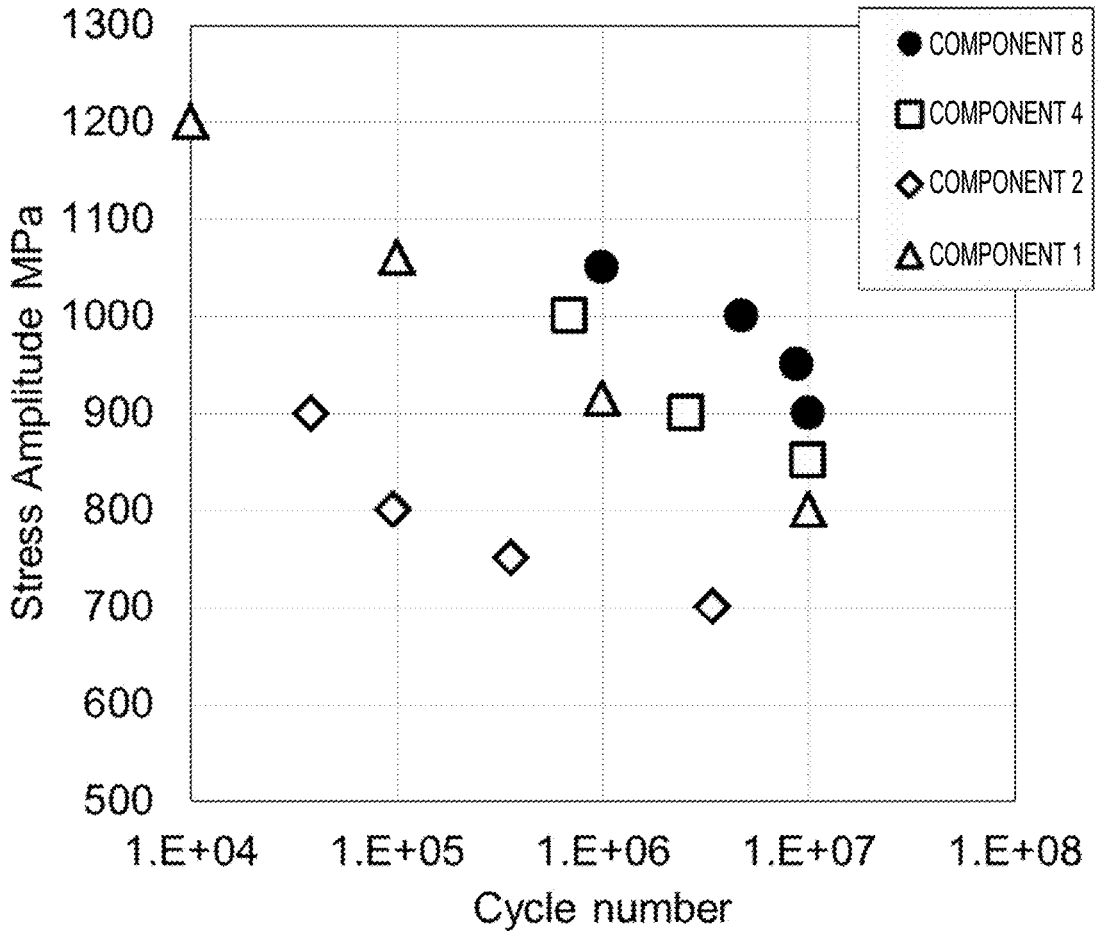
FIG. 5 is a diagram illustrating an S-N curve obtained by a rotary bending fatigue test as carried out on components 1, 2, 4, and 8 evaluated in examples.

FIG. 5 illustrates an S-N curve. In FIG. 5, curves located on upper positions indicate higher fatigue strength, and the components 8, 4, 1, and 2 exhibited highest fatigue strength in this order. The component 8 exhibited the most excellent fatigue strength since the carbide observed at the surface layer portion was not large and coarse and crystal particles were also fine. Although the component 2 was high-nitrogen steel, it was considered that the component 2 had degraded fatigue strength due to a large amount of large and coarse carbide at the surface layer portion, which served as a start point of fatigue.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A martensite-based stainless steel component that has a nitride layer on a surface of martensite-based stainless steel with a constituent composition of, in percent by mass, 0.25 to 0.45% of C, 1.0% or less of Si, 0.1 to 1.5% of Mn, 12.0 to 15.0% of Cr, and 0.5 to 3.0% of Mo, with the remainder being Fe and impurities, wherein a hardness at a position of a depth of 0.1 mm from a surface of the martensite-based stainless steel component is 650 HV or more, and a number density of carbide particles with an equivalent circle diameter of 1 μm or more is 100 particles/10,000 $\mu m^2$ or less in a sectional structure at a position of a depth of 0.1 mm from the surface of the martensite-based stainless steel component.

2. The martensite-based stainless steel component according to claim 1, wherein a thickness of a compound layer that the nitride layer has is 1 μm or less.

3. The martensite-based stainless steel component according to claim 1, wherein the constituent composition of the martensite-based stainless steel further includes, in percent by mass, 0.3% or less of Nb.

4. The martensite-based stainless steel component according to claim 1, wherein the constituent composition of the martensite-based stainless steel further includes, in percent by mass, 0.3% or less of V.

5. The martensite-based stainless steel component according to claim 1, wherein the constituent composition of the martensite-based stainless steel further includes, in percent by mass, 3.0% or less of W.

6. The martensite-based stainless steel component according to claim 1, wherein the constituent composition of the martensite-based stainless steel further includes, in percent by mass, 1.0% or less of Ni.

7. A method for manufacturing a martensite-based stainless steel component comprising:

performing quenching of heating martensite-based stainless steel with a constituent composition of, in percent by mass, 0.25 to 0.45% of C, 1.0% or less of Si, 0.1 to 1.5% of Mn, 12.0 to 15.0% of Cr, and 0.5 to 3.0% of Mo, with the remainder being Fe and impurities, at a temperature of 1000 to 1150° C. in a nitrogen atmosphere and then cooling the martensite-based stainless steel, and then performing tempering thereon, wherein a hardness at a position of a depth of 0.1 mm from a surface of the martensite-based stainless steel component is 650 HV or more, and a number density of carbide particles with an equivalent circle diameter of 1 μm or more is 100 particles/10,000

$\mu m^2$ or less in a sectional structure at a position of a depth of 0.1 mm from the surface of the martensite-based stainless steel component.

8. The method for manufacturing a martensite-based stainless steel component according to claim 7, wherein the constituent composition of the martensite-based stainless steel further includes, in percent by mass, 0.3% or less of Nb.

9. The method for manufacturing a martensite-based stainless steel component according to claim 7, wherein the constituent composition of the martensite-based stainless steel further includes, in percent by mass, 0.3% or less of V.

10. The method for manufacturing a martensite-based stainless steel component according to claim 7, wherein the constituent composition of the martensite-based stainless steel further includes, in percent by mass, 3.0% or less of W.

11. The method for manufacturing a martensite-based stainless steel component according to claim 7, wherein the constituent composition of the martensite-based stainless steel further includes, in percent by mass, 1.0% or less of Ni.

* * * * *